US009845447B2

(12) United States Patent
Erickson et al.

(10) Patent No.: US 9,845,447 B2
(45) Date of Patent: Dec. 19, 2017

(54) METHOD OF GENERATING CARBONATE IN SITU IN A USE SOLUTION AND OF BUFFERED ALKALINE CLEANING UNDER AN ENRICHED CO2 ATMOSPHERE

(71) Applicant: Ecolab USA Inc., St. Paul, MN (US)

(72) Inventors: Anthony W. Erickson, Golden Valley, MN (US); Peter J. Fernholz, Burnsville, MN (US)

(73) Assignee: Ecolab USA Inc., Saint Paul, MN (US)

( * ) Notice: Subject to any disclaimer, the term of this patent is extended or adjusted under 35 U.S.C. 154(b) by 236 days.

(21) Appl. No.: 14/933,744

(22) Filed: Nov. 5, 2015

(65) Prior Publication Data

US 2016/0060577 A1 Mar. 3, 2016

Related U.S. Application Data

(62) Division of application No. 13/804,814, filed on Mar. 14, 2013, now Pat. No. 9,206,380.

(51) Int. Cl.
*C11D 3/10* (2006.01)
*B08B 9/08* (2006.01)
(Continued)

(52) U.S. Cl.
CPC ..... *C11D 3/10* (2013.01); *B08B 3/08* (2013.01); *B08B 3/10* (2013.01); *B08B 9/0804* (2013.01);
(Continued)

(58) Field of Classification Search
None
See application file for complete search history.

(56) References Cited

U.S. PATENT DOCUMENTS 4,219,333 A 8/1980 Harris
4,251,494 A 2/1981 Say
(Continued)

FOREIGN PATENT DOCUMENTS

EP 1170567 A1 1/2002
JP 6287206 A 4/1987
(Continued)

OTHER PUBLICATIONS

"The Oxford Companion to Beer", Oxford University Press, Inc., 2012, 5 pages.

*Primary Examiner* — Nicole Blan
(74) *Attorney, Agent, or Firm* — McKee, Voorhees & Sease, PLC

(57) ABSTRACT

The invention is directed to methods of generating carbonate in situ in a use solution under an enriched $CO_2$ atmosphere. In another aspect, the invention is directed to methods of cleaning food processing surfaces under an enriched $CO_2$ atmosphere comprising contacting a food processing surface with a cleaning composition comprised of an alkalinity source, a surfactant, and water, monitoring the pH during the wash cycle and adjusting the pH by recirculating a use solution, adding a secondary alkalinity source, or both recirculating a use solution and adding a secondary alkalinity source, to generate carbonate in situ in the use solution. In a particular embodiment of the invention the alkalinity source is an alkali metal carbonate and the secondary alkalinity source is an alkali metal hydroxide.

16 Claims, 5 Drawing Sheets

(51) Int. Cl.

| | |
|---|---|
| ***B08B 3/08*** | (2006.01) |
| ***C11D 3/386*** | (2006.01) |
| ***C11D 11/00*** | (2006.01) |
| ***B08B 3/10*** | (2006.01) |
| ***C11D 3/04*** | (2006.01) |
| ***C11D 3/00*** | (2006.01) |

(52) U.S. Cl.
CPC ..... *C11D 3/0052* (2013.01); *C11D 3/044* (2013.01); *C11D 3/386* (2013.01); *C11D 11/0041* (2013.01)

(56) References Cited

U.S. PATENT DOCUMENTS

| | | | | |
|---|---|---|---|---|
| 4,806,277 | A | 2/1989 | Sakurai et al. | |
| 5,244,468 | A | 9/1993 | Harris et al. | |
| 5,593,091 | A | 1/1997 | Harris | |
| 5,663,132 | A | 9/1997 | Talley | |
| 6,042,629 | A * | 3/2000 | McGarrity ..... | B08B 9/027 134/27 |
| 6,203,691 | B1 | 3/2001 | Hoffman, Jr. et al. | |
| 6,277,801 | B1 | 8/2001 | Dahanayake et al. | |
| 6,313,086 | B1 | 11/2001 | Askew et al. | |
| 6,357,454 | B1 | 3/2002 | Yokota et al. | |
| 6,387,337 | B1 | 5/2002 | Pennline et al. | |
| 6,455,017 | B1 | 9/2002 | Kasting, Jr. et al. | |
| 6,890,497 | B2 | 5/2005 | Rau et al. | |
| 8,119,091 | B2 | 2/2012 | Keith et al. | |
| 8,122,704 | B2 | 2/2012 | Hago et al. | |
| 2004/0018245 | A1 | 1/2004 | Steen | |
| 2004/0182425 | A1 * | 9/2004 | Kravitz ..... | C11D 3/48 134/26 |
| 2005/0130868 | A1 | 6/2005 | Evans et al. | |
| 2005/0194022 | A1 | 9/2005 | Schwartz | |
| 2006/0005316 | A1 | 1/2006 | Durrant | |
| 2006/0276366 | A1 | 12/2006 | Deljosevic et al. | |
| 2007/0000067 | A1 | 1/2007 | Shi et al. | |
| 2007/0037729 | A1 | 2/2007 | Mathur | |
| 2007/0203047 | A1 | 8/2007 | Pegelow et al. | |
| 2007/0232517 | A1 | 10/2007 | Evans et al. | |
| 2008/0096784 | A1 | 4/2008 | Barg et al. | |
| 2009/0139546 | A1 | 6/2009 | Laffitte et al. | |
| 2009/0199875 | A1 | 8/2009 | Fernholz et al. | |
| 2012/0065121 | A1 | 3/2012 | Ebberts | |
| 2012/0329700 | A1 | 12/2012 | Silvernail et al. | |

FOREIGN PATENT DOCUMENTS

| | | | |
|---|---|---|---|
| JP | 6179991 | A | 6/1994 |
| JP | 780425 | A | 3/1995 |
| JP | 08112574 | A | 5/1996 |
| JP | 9234438 | A | 9/1997 |
| JP | 9279371 | A | 10/1997 |
| JP | 1094768 | A | 4/1998 |
| JP | 10088190 | A | 4/1998 |
| JP | 2000325903 | A | 11/2000 |
| JP | 2001009401 | A | 1/2001 |

* cited by examiner

METHOD OF GENERATING CARBONATE IN SITU IN A USE SOLUTION AND OF BUFFERED ALKALINE CLEANING UNDER AN ENRICHED CO2 ATMOSPHERE

CROSS-REFERENCE TO RELATED APPLICATIONS

This is a Divisional Application of U.S. Ser. No. 13/804,814 filed Mar. 14, 2013, herein incorporated by reference in its entirety.

FIELD OF THE INVENTION

The invention relates to methods of generating carbonate in situ in use solutions under an enriched $CO_2$ atmosphere, particularly useful for removing soils from food processing surfaces. In an embodiment, the invention relates to methods of cleaning brewery equipment under $CO_2$ atmosphere with the carbonate use solution generated in situ.

BACKGROUND OF THE INVENTION

In many industrial applications, such as the manufacture of foods and beverages, hard surfaces commonly become contaminated with soils such as carbohydrate, proteinaceous, and hardness soils, food oil soils, fat soils, and other soils. Such soils can arise from the manufacture of both liquid and solid foodstuffs. Carbohydrate soils, such as cellulosics, monosaccharides, disaccharides, oligosaccharides, starches, gums, and other complex materials, when dried, can form tough, hard to remove soils, particularly when combined with other soil components such as proteins, fats, oils, minerals, and others. The removal of such carbohydrate soils can be a significant problem. Similarly, other materials such as proteins, fats, and oils can also form hard to remove soil and residues.

Food and beverage soils are particularly tenacious when they are heated during processing. Foods and beverages are heated for a variety of reasons during processing. For example, in dairy plants, dairy products are heated on a pasteurizer (e.g., HTST—high temperature short-time—pasteurizer or UHT—ultra-high temperature—pasteurizer) in order to pasteurize the dairy product. In brewing, wort is boiled to breakdown the components of the grain into fermentable sugars. Also, many food and beverage products are concentrated or created as a result of evaporation.

Specific examples of food and beverage products that are concentrated using evaporators include dairy products such as whole and skimmed milk, condensed milk, whey and whey derivatives, buttermilk, proteins, lactose solutions, and lactic acid; protein solutions such as soya whey, nutrient yeast and fodder yeast, and whole egg; fruit juices such as orange and other citrus juices, apple juice and other pomaceous juices, red berry juice, coconut milk, and tropical fruit juices; vegetable juices such as tomato juice, beetroot juice, carrot juice, and grass juice; starch products such as glucose, dextrose, fructose, isomerose, maltose, starch syrup, and dextrine; sugars such as liquid sugar, white refined sugar, sweetwater, and inulin; extracts such as coffee and tea extracts, hop extract, malt extract, yeast extract, pectin, and meat and bone extracts; hydrolyzates such as whey hydrolyzate, soup seasonings, milk hydrolyzate, and protein hydrolyzate; beer such as de-alcoholized beer and wort; and baby food, egg whites, bean oils, and fermented liquors.

Clean-in-place (CIP) cleaning techniques are a specific cleaning regimen adapted for removing soils from the internal components of tanks, lines, pumps, and other process equipment used for processing typically liquid product streams such as beverages, milk, juices, etc. CIP cleaning involves passing cleaning solutions through the system without dismantling any system components. The minimum CIP technique involves passing the cleaning solution through the equipment and then resuming normal processing. Any product contaminated by cleaner residue can be discarded. Often CIP methods involve a first rinse, the application of the cleaning solutions, and a second rinse with potable water followed by resumed operations. The process can also include any other contacting step in which a rinse, acidic or basic functional fluid, solvent or other cleaning component such as hot water, cold water, etc. can be contacted with the equipment at any step during the process. Often the final potable water rinse is skipped in order to prevent contamination of the equipment with bacteria following the cleaning and/or sanitizing step.

Conventional CIP techniques however are not always sufficient at removing all types of soils. Specifically, it has been found that low density organic soils, e.g., ketchup, barbeque sauce, are not easily removed using traditional CIP cleaning techniques. Thermally degraded soils are also particularly difficult to remove using conventional CIP techniques.

Brewery soils are another type of soil that is particularly difficult to remove from a surface. Brewing beer and wine requires the fermentation of sugars derived from starch-based material e.g., malted barley or fruit juice, e.g., grapes. Fermentation uses yeast to turn the sugars in wort or juice to alcohol and carbon dioxide. During fermentation, the wort becomes beer and the juice becomes wine. Once the boiled wort is cooled and placed in a fermenter, yeast and/or bacteria is propagated in the wort and it is left to ferment, which requires a week to months depending on the type of yeast or bacteria and style of the beer or wine. In addition to producing alcohol, fine particulate matter suspended in the wort settles during fermentation. Once fermentation is complete, the yeast also settles, leaving the beer or wine clear, but the fermentation tanks soiled with dead yeast cells, proteins, hop resins, and/or grape skins.

Fermentation is sometimes carried out in two stages, primary and secondary. Once most of the alcohol has been produced during primary fermentation, the beer is transferred to a new vessel and allowed a period of secondary fermentation. Secondary fermentation is used when the beer requires long storage before packaging or greater clarity.

Often during the fermentation process in commercial brewing, the fermentation tanks develop a ring of soil, i.e., brandhefe ring, which is particularly difficult to remove. Brandhefe rings are tough, tacky material composed of dried-up yeast, albumen, and hop resins. Traditional CIP methods of cleaning fermentation tanks do not always remove this soil. Thus, brewers often resort to climbing inside of the tanks and manually scrubbing them to remove the soil.

Furthermore, traditional CIP cleaning is performed in one of two ways with a caustic cleaning composition typically composed of sodium hydroxide or with an acid-based cleaning composition. Both traditional methods of CIP cleaning suffer from a number of setbacks. Acidic systems provide inferior cleaning and often are unable to adequately remove the aforementioned soils. This results in the need to expend greater time, energy, and effort to adequately clean the food processing surface. Alkaline cleaning systems are generally more effective at removing the soils; however, they suffer from problems of their own. Traditional caustic soda-based cleaning cannot be performed under high $CO_2$ conditions due to the risk of tank implosion caused by the removal of $CO_2$ by reaction with sodium hydroxide. Various types of food processing surfaces are often under an enriched $CO_2$ atmosphere. For example, in brewery applications this may be the result of intentionally creating the enriched $CO_2$ atmosphere to exclude oxygen from the vessel during fermentation or as a by-product of fermentation. When caustic soda is used under an enriched $CO_2$ atmosphere, it reacts with the $CO_2$, which results in substantial reduction in pressure. The change in pressure is so substantial that the tank will implode. Thus, in order to clean under alkaline conditions with caustic soda, the food processing surface must be vented to remove the $CO_2$. Adequate venting can take extensive amounts of time. This increases the amount of time that the food processing surface is soiled and not in condition to be used for its intended purpose, which is not time or cost effective.

Moreover, traditional caustic cleaning methods necessitate fairly high temperatures for optimal cleaning. Typical cleaning must be performed at temperatures of at least about 60-75° C. Therefore, the existing cleaning methods require the additional time and energy to sufficiently heat the food processing surface or washing vessel.

Thus, there is a significant need for an alkaline cleaning system capable of cleaning under an enriched $CO_2$ atmosphere. Moreover, there is a need for an improved method for removing food and beverage soils that are not easily removed using conventional cleaning techniques. Furthermore, there is a need for an improved method for removing food and beverage soils at lower temperatures than existing methods. It is against this background that the present invention has been made.

Accordingly, it is an objective of the claimed invention to develop a highly effective alkaline cleaning system for food processing surfaces.

It is a further object of the claimed invention to provide an alkaline cleaning system that can be used under an enriched $CO_2$ atmosphere.

It is a further object of the claimed invention to provide a cleaning system that overcomes the problems in the art that prevent cleaning with caustic formulas or require extensive time—often four to twelve hours—to vent the $CO_2$ from a food processing surface.

A further object of the invention is to develop a system that allows for lower temperature cleaning, which decreases the energy and time necessary to heat up the food processing surface.

BRIEF SUMMARY OF THE INVENTION

An advantage of the invention is that it provides a method for highly effective alkaline cleaning under an enriched $CO_2$ atmosphere by generating carbonate in situ in a use solution.

Another advantage of the claimed invention is that it overcomes the problems in the art that prevent cleaning with alkaline formulas under an enriched $CO_2$ atmosphere.

Another advantage of the claimed invention is that it provides a cleaning system that is highly effective at lower temperatures, which results in substantial reduction of energy and time necessary to heat up the food processing surface for cleaning.

In an embodiment, the present invention is a method for generating carbonate in situ in a use solution under an enriched $CO_2$ atmosphere by adding a carbonate-based alkalinity source to the enriched $CO_2$ atmosphere to form a use solution, monitoring the equilibrium of carbonic acid, carbonate, and bicarbonate in the use solution, adjusting the equilibrium of the use solution, and generating carbonate in the use solution. In a further aspect of the invention, the monitoring of the use solution may be monitoring of the pH, conductivity, or both. In still a further aspect of the invention, the pH of the use solution may be maintained between about 8 and about 13. In still a further aspect of the invention, the equilibrium may include hydroxide.

In an embodiment, the present invention is a method for cleaning a food processing surface by applying a cleaning composition comprised of an alkalinity source, a surfactant, and water to the food processing surface, monitoring the pH during the wash cycle, adjusting the pH, and generating carbonate in situ in the use solution. In a further aspect of the invention, the cleaning composition may include an enzyme composition. In another aspect of the invention, the cleaning method may be performed under an enriched $CO_2$ atmosphere. In a further aspect of the invention, the pH may be maintained between about 8 and about 12.

In a particular embodiment of the invention, the method of cleaning may be a CIP technique. In another embodiment of the invention, the method of cleaning may be directed at brewery surfaces.

In another aspect of the invention, the pH of the use solution may be adjusted by recirculating a use solution in the washing vessel, by adding a secondary alkalinity source, or by a combination of both recirculating a use solution and by adding a secondary alkalinity source.

In another embodiment of the invention the method of cleaning can be performed between about 10° C. and about 60° C.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
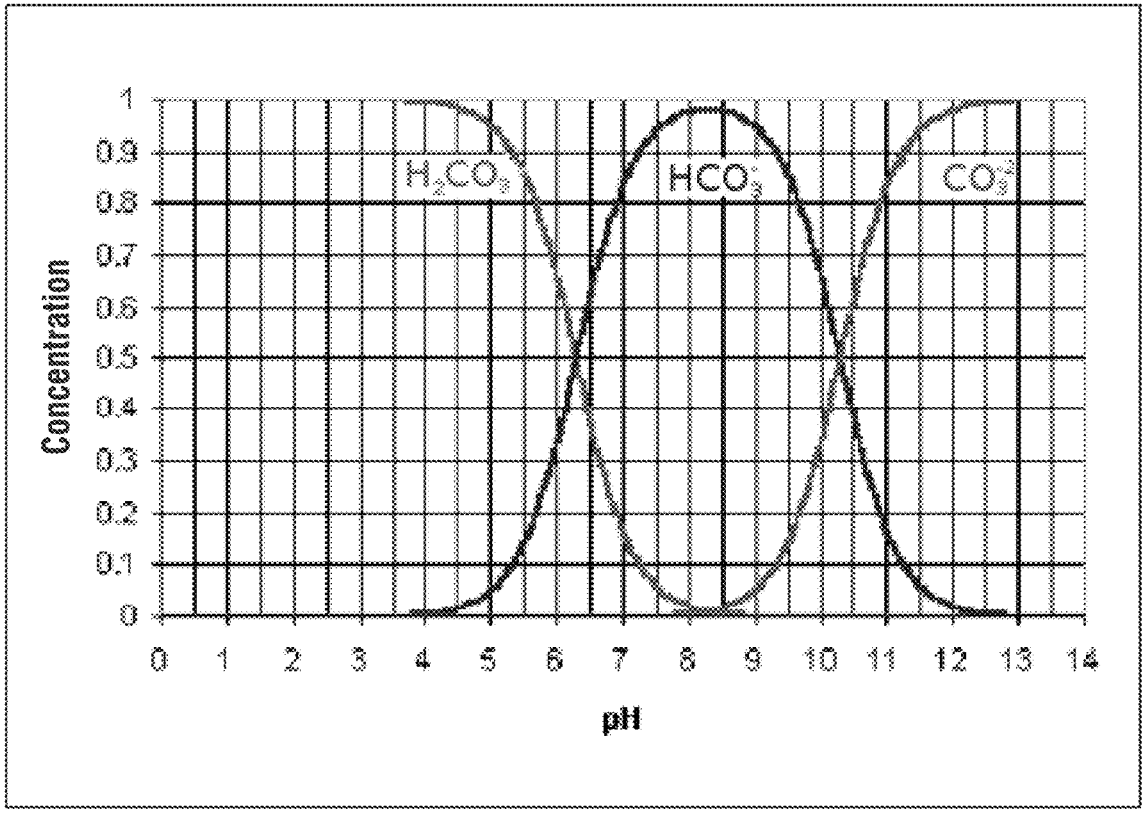
FIG. 1 shows the equilibrium of carbonate, bicarbonate, and carbonic acid in a particular embodiment of the invention.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE INVENTION

The present invention relates to a method of generating carbonate in situ in a use solution. In a particular embodiment, the generation of carbonate in situ in the use solution can be employed to achieve and maintain an alkaline cleaning system capable of cleaning under an enriched $CO_2$ atmosphere. The cleaning system provided by the method of generating carbonate in situ in a use solution of the present invention has many advantages over existing cleaning systems and compositions. For example, the present invention provides the ability to perform alkaline cleaning under an enriched $CO_2$ atmosphere without the risk of tank implosion. The present invention eradicates the need to vent the vessel of $CO_2$. Thus, the vessel is cleaned more quickly and is ready for subsequent use in less time. Furthermore, the cleaning system is effective at lower temperatures, thereby saving both time and energy.

The embodiments of this invention are not limited to particular CIP vessels or cleaning of particular soils, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an," and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including hetero aromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "anti-redeposition agent" refers to a compound that helps keep suspended in water instead of redepositing onto the object being cleaned. Anti-redeposition agents are useful in the present invention to assist in reducing redepositing of the removed soil onto the surface being cleaned.

As used herein, the phrase "brewery surface" refers to a surface of a tool, a machine, equipment, a structure, a building, or the like that is employed as part of a brewing, making, distilling, preparation, bottling, canning, and storage, etc. of beer, wine, liquor, and spirits. Brewery surface is intended to encompass all surfaces used in brewing (including beer brewing and preparation of liquors and spirits) and winemaking processes. Examples of brewery surfaces include fermentation vessels, bright beer tanks and lines, mash tuns, bottling equipment, pipes, storage vessels, bottling and canning equipment, etc.

As used herein, the phrases "CIP equipment" and "CIP tank" or any variations thereof, refer to tanks, vessels, apparatuses, lines, pumps, and other process equipment used for processing typically liquid product streams such as beverages, milk, juices, etc. used in CIP cleaning techniques for removing soils from the internal components. It encompasses any CIP food processing surfaces and CIP brewery surfaces.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

As used herein, the phrase "enriched $CO_2$ atmosphere," or any variations thereof, refer to an atmosphere composed of about 25% to about 100% $CO_2$ at 1 atm. As used herein, the phrase "ambient $CO_2$" refers to normal atmospheric $CO_2$ content, i.e., from about 390 ppm to about 410 ppm.

As used herein, the phrase "food processing surface" refers to a surface of a tool, a machine, equipment, a structure, a building, or the like that is employed as part of a food or beverage processing, preparation, or storage activity. Food processing surface is intended to encompass all surfaces used in brewing (including beer brewing and preparation of liquors and spirits) and winemaking processes (e.g., bright beer tanks and lines, fermentation vessels, mash tuns, bottling equipment, pipes, and storage vessels). Examples of food processing surfaces include surfaces of food processing or preparation equipment (e.g., boiling, fermenting, slicing, canning, or transport equipment, including flumes), of food processing wares (e.g., utensils, dishware, wash ware, and bar glasses), and of floors, walls, or fixtures of structures in which food processing occurs. Food processing surfaces are found and employed in food antispoilage air circulation systems, aseptic packaging sanitizing, food refrigeration and cooler cleaners and sanitizers, ware washing sanitizing, blancher cleaning and sanitizing, food packaging materials, cutting board additives, third-sink sanitizing, beverage chillers and warmers, meat chilling or scalding waters, autodish sanitizers, sanitizing gels, cooling towers, food processing antimicrobial garment sprays, and non-to-low-aqueous food preparation lubricants, oils, and rinse additives.

The term "hard surface" refers to a solid, substantially non-flexible surface such as a counter top, tile, floor, wall, panel, window, plumbing fixture, kitchen and bathroom furniture, appliance, engine, circuit board, and dish. Hard surfaces may include for example, health care surfaces and food processing surfaces.

As used herein, the term "phosphorus-free" or "substantially phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-%, and most preferably the amount of phosphorus is less than 0.01 wt %.

As used herein, the term "soil" refers to a non-polar oily substance which may or may not contain particulate matter such as organic soils, mineral clays, sand, natural mineral matter, carbon black, graphite, kaolin, environmental dust, proteins, fats, oils, minerals, dried-up yeast, albumen, and hop resins, any by-product of food and beverage preparation, etc.

The term "threshold agent" refers to a compound that inhibits crystallization of water hardness ions from solution, but that need not form a specific complex with the water hardness ion. Threshold agents include but are not limited to a polyacrylate, a polymethacrylate, an olefin/maleic copolymer, and the like.

As used herein the phrase, "use solution," and obvious variations of the same, refer to a solution that contacts an object or surface to provide the desired cleaning, rinsing, or the like. In a particular embodiment of the invention, the use solution may contain a cleaning composition diluted to the desired concentration. In a further embodiment, the use solution may contain a cleaning composition in concentrate. It should be understood that the concentration of the alkalinity source, surfactant, enzymes, water and other optional ingredients in the cleaning composition will vary depending on whether the cleaning composition is provided as a concentrate or is diluted.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

Compositions Employed According to the Invention

The method of the present invention can employ a variety of suitable cleaning compositions and use solutions. Those of skill in the art will be able to formulate or select a suitable cleaning composition for the particular cleaning application at hand, e.g., based on the soil to be cleaned. In a particular embodiment of the present invention the cleaning composition employed comprises: (1) an alkalinity source in an amount between about 0.1 wt. % and about 5 wt. %, or more particularly between about 0.5 wt. % and about 2 wt. %; (2) a surfactant between about 0.005 wt. % and about 1 wt. %, or more particularly between about 50 ppm and 200 ppm; and (3) balance water. In another embodiment of the invention, the alkalinity source and surfactant can be kept in a concentrate, either preformulated together to the desired ratio or kept separate, and mixed and diluted on site to form a cleaning composition and/or use solution.

The methods of the present invention may comprise, consist essentially of, or consist of the various steps and the components and ingredients set forth for employing cleaning compositions as well as other ingredients described herein. As used herein, "consisting essentially of" means that the methods and compositions may include additional steps, components or ingredients, but only if the additional steps, components or ingredients do not materially alter the basic and novel characteristics of the claimed methods.

Alkalinity Source

The method of cleaning can include an effective amount of one or more alkalinity sources to enhance cleaning of a food processing surface and improve soil removal performance of the method. In general, it is expected that the method will include the alkalinity source in an amount between about 0.1% and about 5% by weight, between about 0.5% and about 2% by weight, and between about 0.8% and about 1.5% by weight of the total weight of the cleaning composition.

An effective amount of one or more alkaline sources should be considered as an amount that provides a cleaning composition having a pH between about 8 and about 13. In a particular embodiment cleaning composition will have a of between about 9 and about 11. During the wash cycle the use solution will have a pH between about 8 and about 13. In particular embodiments, the use solution will have a pH between about 9 and 11. When the cleaning composition includes an enzyme composition, the pH may be modulated to provide the optimal pH range for the enzyme compositions effectiveness. In a particular embodiment of the invention incorporating an enzyme composition in the cleaning composition, the optimal pH is about 11.

Examples of suitable alkaline sources of the cleaning composition include, but are not limited to carbonate-based alkalinity sources, including, for example, carbonate salts such as alkali metal carbonates; caustic-based alkalinity sources, including, for example, alkali metal hydroxides; other suitable alkalinity sources may include metal silicate, metal borate, and organic alkalinity sources. Exemplary alkali metal carbonates that can be used include, but are not limited to, sodium carbonate, potassium carbonate, bicarbonate, sesquicarbonate, and mixtures thereof. Exemplary alkali metal hydroxides that can be used include, but are not limited to sodium, lithium, or potassium hydroxide. Exemplary metal silicates that can be used include, but are not limited to, sodium or potassium silicate or metasilicate. Exemplary metal borates include, but are not limited to, sodium or potassium borate. In addition to the first alkalinity source, the cleaning composition and/or use solution may comprise a secondary alkalinity source. Examples of useful secondary alkaline sources include those described above.

Organic alkalinity sources are often strong nitrogen bases including, for example, ammonia (ammonium hydroxide), amines, alkanolamines, and amino alcohols. Typical examples of amines include primary, secondary or tertiary amines and diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups. Typical examples of alkanolamines include monoethanolamine, monopropanolamine, diethanolamine, dipropanolamine, triethanolamine, tripropanolamine and the like. Typical examples of amino alcohols include 2-amino-2-methyl-1-propanol, 2-amino-1-butanol, 2-amino-2-methyl-1,3-propanediol, 2-amino-2-ethyl-1,3-propanediol, hydroxymethyl aminomethane, and the like.

In general, alkalinity sources are commonly available in either aqueous or powdered form, either of which is useful in formulating the present solid detergent compositions. The alkalinity may be added to the composition in any form known in the art, including as solid beads, granulated or particulate form, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution.

Enzymes

Various enzymes can be used for the compositions according to the invention to break down adherent soils, such as starch or proteinaceous materials, typically found in soiled surfaces and typically treated with cleaning compositions. Various enzymes for use according to the invention to decrease and/or eliminate the soils on a treated substrate may be utilized in combination with the organic activator-stabilizer compounds.

According to an embodiment of the invention, the composition includes at least one enzyme. According to a further embodiment of the invention, the composition includes at least two enzymes. According to a still further embodiment of the invention, the composition includes at least three enzymes. In a particular embodiment of the invention, three enzymes of different classes are incorporated into the cleaning composition.

Enzymes may act by degrading or altering one or more types of soil residues encountered on a food processing surface, thus removing the soil or making the soil more removable by a surfactant or other component of the cleaning composition. Both degradation and alteration of soil residues can improve detergency by reducing the physicochemical forces which bind the soil to the food processing surface being cleaned, i.e., the soil becomes more water soluble.

For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. In a particular embodiment, the enzyme may be a combination of a protease, a cellulase, and an amylase. An enzyme may be present in a cleaning composition or use solution employed in the method of cleaning from at least about 0.005 wt. % to about 1.75 wt. %. In a particular embodiment of the invention the enzyme may be present in the cleaning composition between about 0.10 wt. % and about 0.35 wt. %. One skilled in the art will ascertain suitable enzymes compositions for use according to the method of cleaning.

Amylase

Suitable amylase enzymes can be derived from a plant, an animal, or a microorganism. Preferably the amylase is derived from a microorganism, such as a yeast, a mold, or a bacterium. Amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase. There are three types of amylases, α-amylase, β-amylase, and γ-amylase.

Examples of amylase enzymes include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include Stainzyme® and the stability enhanced variant amylase sold under the trade name Duramyl® by Novozymes, Inc. A mixture of amylases can also be used.

Suitable amylases include: I-amylases described in WO 95/26397, PCT/DK96/00056, and GB 1,296,839 to Novo; and stability enhanced amylases described in J. Biol. Chem., 260(11):6518-6521 (1985); WO 9510603 A, WO 9509909 A and WO 9402597 to Novo; references disclosed in WO 9402597; and WO 9418314 to Genencor International. Each of these references is incorporated in its entirety. A variant I-amylase can be at least 80% homologous, having at least 80% sequence identity, with the amino acid sequences of the proteins of these references.

Naturally, mixtures of different amylase enzymes can be used. While various specific enzymes have been described above, it is understood that any amylase which can confer the desired amylase activity to the composition can be used.

Cellulases

Suitable cellulases can be derived from a plant, an animal, or a microorganism. Preferably the cellulase is derived from a microorganism, such as a fungus or a bacterium. Cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella auricula* Solander. The cellulase can be purified or a component of an extract, and either wild type or variant (either chemical or recombinant).

Examples of cellulase enzymes include those sold under the trade names Carezyme® or Celluzyme® by Novo, or Cellulase by Genencor; and the like. A mixture of cellulases can also be used. Suitable cellulases are described in patent documents, including: U.S. Pat. No. 4,435,307, GB-A-2.075.028, GB-A-2.095.275, DE-OS-2.247.832, WO 9117243, and WO 9414951 A (stabilized cellulases) to Novo. Each of which is incorporated in its entirety.

Naturally, mixtures of different cellulase enzymes can be used. While various specific enzymes have been described above, it is to be understood that any cellulase which can confer the desired cellulase activity to the composition can be used.

Lipase

A suitable lipase can be derived from a plant, an animal, or a microorganism. Preferably the lipase is derived from a microorganism, such as a fungus or a bacterium. Preferred lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be used include those sold under the trade names Lipase P "Amano" or "Amano-P" by Amano Pharmaceutical Co. Ltd., Nagoya, Japan or under the trade name Lipolase® by Novo, and the like. Other commercially available lipases that can be used include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa.*

Naturally, mixtures of different lipase enzymes can be used. While various specific enzymes have been described above, it is to be understood that any lipase which can confer the desired lipase activity to the composition can be used.

Peroxidase

Suitable peroxidases can be derived from plants (e.g., horseradish peroxidase), microorganisms, including, but not limited to, basidiomycetes, fungi, actinomycetes, and bacteria. Some preferred microorganisms include strains of *Fusarium*, in particular *Fusarium oxysporum*, strains of *Streptomyces*, in particular *Streptomyces thermoviolaceus* or *Streptomyces viridosporus*, strains of *Pseudomonas*, preferably *Pseudomonas putida* or *Pseudomonas fluorescens*, strains of *Coprinus*, in particular *Coprinus cinereus, Coprinus macrorhizus* or *Coprinus ciereus* f. *microsporus*, strains of *Streptovercillium*, in particular *Streptoverticillium verticillium* ssp. *verticillium*, strains of *Bacillus*, in particular *Bacillus stearothermophilus*, and strains of *Coriolus*, preferably *Coriolus versicolor*, strains of *Phanerochaete*, in particular *Phanerochaete chrysosporium*. Another group of useful peroxidases is constituted by the ligninases: these enzymes which exert a strong peroxidase activity are instrumental in the degradation of lignin (e.g., in wood) and are produced by a variety of wood rot fungi. Further useful peroxidases are haloperoxidases, such as chloroperoxidases and bromoperoxidases, as they are able to oxidize halide ions to hypohalites which are powerful bleaching agents, apart from being able to oxidize organic compounds. Peroxidase enzymes can be used in combination with oxygen sources, e.g., percarbonate, perborate, and hydrogen peroxide.

The peroxidase can be purified or a component of an extract, and either wild type or variant (either chemical or recombinant). Naturally, mixtures of different peroxidase enzymes can be used. Suitable peroxidases are disclosed in WO 8909813, which is incorporated in its entirety. While various specific enzymes have been described above, it is to be understood that any perodidase which can confer the desired peroxidase activity to the composition can be used.

Protease

Suitable protease enzymes can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). Examples of proteolytic enzymes include (with trade names) Coronase®; Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Commercially available protease enzymes include those sold under the trade names Coronase®, Alcalase®, Savinase®, Primase®, Durazym®, or Esperase® by Novozymes A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like.

A mixture of such proteases can also be used. For example, Purafect® is an alkaline protease (a subtilisin) having application in lower temperature cleaning programs, from about 30° C. to about 65° C.; whereas, Esperase® is an alkaline protease of choice for higher temperature detersive solutions, from about 50° C. to about 85° C. Detersive proteases are described in patent publications, including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. Each of these references is incorporated in its entirety. A variant protease may be at least 80% homologous, having at least 80% sequence identity, with the amino acid sequences of the proteases in these references.

Naturally, mixtures of different proteolytic enzymes may be used. While various specific enzymes have been described above, it is understood that any protease which can confer the desired proteolytic activity to the composition may be used.

Additional Enzymes

Naturally, mixtures of different additional enzymes can be incorporated into this invention. While various specific enzymes have been described above, it is to be understood that any additional enzyme which can confer the desired enzyme activity to the composition can be used. Additional suitable enzymes may include a cutinase or gluconase. Suitable cutinase enzymes are described in WO 8809367, which is incorporated in its entirety.

Additional Enzyme Stabilizers

The compositions for use in the methods of the present invention may further include enzyme stabilizers. One skilled in the art will ascertain suitable enzyme stabilizers and/or stabilizing systems for enzyme compositions suitable for use according to the invention, and may include those described, for example, in U.S. Pat. Nos. 7,569,532 and 6,638,902, each of which are incorporated in their entirety. An additional enzyme stabilizing system may include a mixture of carbonate and/or bicarbonate and can also include other ingredients to stabilize certain enzymes or to enhance or maintain the effect of the mixture of carbonate and bicarbonate. An enzyme stabilizer may further include boron compounds or calcium salts. For example, enzyme stabilizers may be boron compounds selected from the group consisting of boronic acid, boric acid, borate, polyborate and combinations thereof.

According to an embodiment of the invention, the additional enzyme stabilizers do not include chlorine bleach scavengers for the prevention of chlorine bleach species attacking and inactivating the enzymes (e.g., alkaline conditions).

According to other embodiments of the invention, the enzyme compositions for use in the methods of the present invention are preferably free of additional enzyme stabilizers. According to a preferred embodiment, the enzyme compositions are free of any enzyme-stabilizing calcium and/or magnesium sources.

Surfactants

In some embodiments, the cleaning compositions employed by the method of cleaning include a surfactant. Surfactants improve soil removal and can be used to prevent the buildup of large quantities of foam generated by soils under alkaline conditions. The surfactant chosen can be compatible with the surface to be cleaned. A variety of surfactants can be used, including anionic, nonionic, cationic, and zwitterionic surfactants, which are commercially available from a number of sources. Suitable surfactants include nonionic surfactants, for example, low foaming non-ionic surfactants. For a discussion of surfactants, see Kirk-Othmer, Encyclopedia of Chemical Technology, Third Edition, volume 8, pages 900-912, which is incorporated in its entirety.

In particular embodiments of the invention, the method of cleaning is directed to brewery surfaces. The soils encountered in brewery surfaces already contain components that are moderate to high foaming. Thus, in such an application, it may be desirous to use a low foaming surfactant or wetting agent to provide wetting properties and better cleaning effectiveness.

In some embodiments, the cleaning compositions and use solutions employed by the method of cleaning include about 0.005 wt. % to about 5 wt. % of a surfactant. In particular embodiments of the present invention, the surfactant comprises between about 0.005 wt. % to about 0.02 wt. % of the cleaning composition or use solution. In another aspect of the invention, the surfactant comprises between about 0.5 wt. % and about 1.0 wt. % of the cleaning composition or use solution. In some embodiments, the compositions of the present invention include about 50 ppm to about 200 ppm of a surfactant.

Nonionic surfactants suitable for use in the methods of the present invention include, but are not limited to, those having a polyalkylene oxide polymer as a portion of the surfactant molecule. Exemplary nonionic surfactants include, but are not limited to, chlorine-, benzyl-, methyl-, ethyl-, propyl-, butyl- and other like alkyl-capped polyethylene and/or polypropylene glycol ethers of fatty alcohols; polyalkylene oxide free nonionics such as alkyl polyglycosides; sorbitan and sucrose esters and their ethoxylates; alkoxylated ethylene diamine; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and ethoxylated amines and ether amines commercially available from Tomah Corporation and other like nonionic compounds. Silicone surfactants such as the ABIL B8852 (Goldschmidt) can also be used.

Additional exemplary nonionic surfactants suitable for use in the methods of the present invention, include, but are not limited to, those having a polyalkylene oxide polymer portion include nonionic surfactants of C6-C24 alcohol ethoxylates (e.g., C6-C14 alcohol ethoxylates) having 1 to about 20 ethylene oxide groups (e.g., about 9 to about 20 ethylene oxide groups); C6-C24 alkylphenol ethoxylates (e.g., C8-C10 alkylphenol ethoxylates) having 1 to about 100 ethylene oxide groups (e.g., about 12 to about 20 ethylene oxide groups); C6-C24 alkylpolyglycosides (e.g., C6-C20 alkylpolyglycosides) having 1 to about 20 glycoside groups (e.g., about 9 to about 20 glycoside groups); C6-C24 fatty acid ester ethoxylates, propoxylates or glycerides; and C4-C24 mono or dialkanolamides.

Exemplary alcohol alkoxylates include, but are not limited to, alcohol ethoxylate propoxylates, alcohol propoxylates, alcohol propoxylate ethoxylate propoxylates, alcohol ethoxylate butoxylates; nonylphenol ethoxylate, polyoxyethylene glycol ethers; and polyalkylene oxide block copolymers including an ethylene oxide/propylene oxide block copolymer such as those commercially available under the trademark PLURONIC (BASF-Wyandotte).

Examples of suitable low foaming nonionic surfactants also include, but are not limited to, secondary ethoxylates, such as those sold under the trade name TERGITOL™, such as TERGITOL™ 15-S-7 (Union Carbide), Tergitol 15-S-3, Tergitol 15-S-9 and the like. Other suitable classes of low foaming nonionic surfactants include alkyl or benzyl-capped polyoxyalkylene derivatives and polyoxyethylene/polyoxypropylene copolymers.

An additional useful nonionic surfactant is nonylphenol having an average of 12 moles of ethylene oxide condensed thereon, it being end capped with a hydrophobic portion including an average of 30 moles of propylene oxide. Silicon-containing defoamers are also well-known and can be employed in the methods of the present invention.

Suitable amphoteric surfactants include, but are not limited to, amine oxide compounds having the formula:

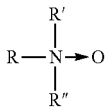

where R, R', R", and R'" are each a $C_1$-$C_{24}$ alkyl, aryl or arylalkyl group that can optionally contain one or more P, O, S or N heteroatoms.

Another class of suitable amphoteric surfactants includes betaine compounds having the formula:

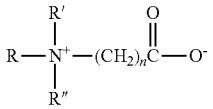

where R, R', R" and R'" are each a $C_1$-$C_{24}$ alkyl, aryl or aralkyl group that can optionally contain one or more P, O, S or N heteroatoms, and n is about 1 to about 10.

Suitable surfactants may also include food grade surfactants, linear alkylbenzene sulfonic acids and their salts, and ethylene oxide/propylene oxide derivatives sold under the Pluronic™ trade name. Suitable surfactants include those that are compatible as an indirect or direct food additive or substance.

Anionic surfactants suitable for use with the disclosed methods may also include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Exemplary anionics include, but are not limited to, sodium alkylarylsulfonate, alpha-olefin sulfonate, and fatty alcohol sulfates. Examples of suitable anionic surfactants include sodium dodecylbenzene sulfonic acid, potassium laureth-7 sulfate, and sodium tetradecenyl sulfonate.

In some embodiments, the surfactant includes linear alkyl benzene sulfonates, alcohol sulfonates, amine oxides, linear and branched alcohol ethoxylates, alkyl polyglucosides, alkyl phenol ethoxylates, polyethylene glycol esters, EO/PO block copolymers and combinations thereof.

In some embodiments, the amount of surfactant in the cleaning composition is about 0.0001 wt % to about 1.0 wt %. Acceptable levels of surfactant include about 0.001 wt % to about 1 wt %, or about 0.002 wt % to about 0.05 wt %. It is to be understood that all values and ranges between these values and ranges are encompassed by the methods of the present invention.

Surfactant Compositions

The surfactants described herein can be used singly or in combination in the methods of the present invention. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants which can find application within the scope of this invention. It should be understood that the selection of particular surfactants or combinations of surfactants can be based on a number of factors including compatibility with the surface to be cleaned at the intended use concentration and the intended environmental conditions including temperature and pH.

In addition, the level and degree of foaming under the conditions of use and in subsequent recovery of the composition can be a factor for selecting particular surfactants and mixtures of surfactants. For example, in certain applications it may be desirable to minimize foaming and a surfactant or mixture of surfactants that provides reduced foaming can be used. In addition, it may be desirable to select a surfactant or a mixture of surfactants that exhibits a foam that breaks down relatively quickly so that the composition can be recovered and reused with an acceptable amount of down time. In addition, the surfactant or mixture of surfactants can be selected depending upon the particular soil that is to be removed.

It should be understood that the compositions for use with the methods of the present invention need not include a surfactant or a surfactant mixture, and can include other components. In addition, the compositions can include a surfactant or surfactant mixture in combination with other components. Exemplary additional components that can be provided within the compositions used in the methods of the present invention include builders, water conditioning agents, non-aqueous components, adjuvants, carriers, processing aids, enzymes, and pH adjusting agents.

Additional Ingredients

The methods of cleaning described herein can optionally include a variety of optional ingredients. In some cases, one or more of the optional ingredient can be integrated cleaning composition. In some cases, one or more of the optional ingredients can be kept separate from the cleaning composition and can subsequently be combined in a use solution at any time before, during, or after the wash cycle.

One skilled in the art will ascertain that optional ingredients may be used in the method according to the invention, such that the ingredients are compatible with the cleaning compositions and method of cleaning. The term "compatible," as used herein, means the additional functional ingredients do not reduce and/or otherwise negatively impact the efficacy of the composition, including the enzymatic activity of the protease or other enzymes, to such an extent that the enzyme is not effective as desired during its intended use according to the methods of the present invention.

The method of the invention may include anti-redeposition agents, buffers, builders, stabilizers, cofactors, inert vehicles, solvents, dyes, fragrances, corrosion inhibitors, combinations of the same. In particular embodiments, the methods do not include dyes, odorants, antimicrobials, or oxidizers.

Anti-Redeposition Agents

Cleaning use solutions can include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A use solution can include 0.005-10 wt %, or 0.1-5 wt %, of an anti-redeposition agent.

Builders

According to embodiments of the invention, the cleaning composition can also include a builder. Builders include chelating agents (chelators), sequestering agents (sequestrants), and the like. The builder may act to stabilize the cleaning composition or use solution. Examples of builders include, but are not limited to, phosphonates, phosphates, aminocarboxylates and their derivatives, pyrophosphates, polyphosphates, ethylenediamene and ethylenetriamene derivatives, hydroxyacids, and mono-, di-, and tri-carboxylates and their corresponding acids. Other exemplary builders include aluminosilicates, nitroloacetates and their derivatives, and mixtures thereof. Still other exemplary builders include aminocarboxylates, including salts of ethylenediaminetetraacetic acid (EDTA), hydroxyethylenediaminetetraacetic acid (HEDTA), and diethylenetriaminepentaacetic acid. For a further discussion of chelating agents/sequestrants, see Kirk-Othmer, Encyclopedia of Chemical Technology, Third Edition, volume 5, pages 339-366 and volume 23, pages 319-320, which is incorporated in its entirety. According to an aspect of the invention, preferred builders are water soluble, biodegradable and phosphorus-free. The amount of builder in the cleaning composition or use solution, if present, is typically between about 10 ppm and about 1000 ppm in the cleaning composition or use solution.

Dyes/Odorants

Various dyes, odorants including perfumes, and other aesthetic enhancing agents can also be included in use solutions. Dyes can be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

In particular embodiments of the invention, e.g., brewery applications, the methods of cleaning may preferably exclude dyes and odorants.

Cleaning Compositions and Use Solutions

The methods of the present invention can employ a variety of suitable cleaning compositions and use solutions. Those of skill in the art will be able to formulate or select a suitable cleaning composition for the particular cleaning application at hand, e.g., based on the soil to be cleaned. In a particular embodiment of the present invention the cleaning composition employed comprises: (1) an alkalinity source in an amount between about 0.1 wt. % and about 5 wt. %, or more particularly between about 0.5 wt. % and about 2 wt. %; (2) a surfactant between about 0.005 wt. % and about 1 wt. %, or more particularly between about 50 ppm and 200 ppm; and (3) balance water.

In another embodiment of the invention the cleaning composition employed by the inventive method may further comprise an enzyme composition. The enzyme composition employed may consist of a single class of enzymes or a mixture of enzyme classes. In a particular embodiment of the invention a mixture of enzymes is incorporated in the cleaning composition in the amount of about 0.035 wt. % and about 1.75 wt. %.

In another embodiment of the invention the cleaning composition may further comprise a builder in an amount between about 10 ppm and about 1000 ppm.

In another aspect of the invention, the cleaning compositions may be substantially phosphorous-free.

According to an embodiment of the invention, the cleaning compositions according to the invention may be incorporated into a solid cleaning composition. Exemplary solid cleaning composition include a solid form such as a powder, a flake, a granule, a pellet, a tablet, a lozenge, a puck, a briquette, a brick, a solid block, a unit dose, or another solid form known to those of skill in the art. The term "solid" refers to the state of the composition under the expected conditions of storage and use of the solid composition. In general, it is expected that the solid composition will remain in solid form when exposed to temperatures of up to about 100° F. and greater than about 120° F. According to a further embodiment of the present invention, the cleaning compositions may be in the liquid form.

According to an embodiment of the invention, the cleaning compositions according to the invention may be incorporated into a solid or a liquid concentrate composition. According to an embodiment of the invention a solid or liquid concentrate can be provided in a suitable formulation to be adfixed inside a washer for multiple use applications. Formulations for multiple-use solids, such as, a block or a plurality of pellets, and can be repeatedly used to generate aqueous compositions for multiple washing cycles.

For example, a solid or liquid concentrate composition may be comprised of at least one alkalinity source and one surfactant, and optionally an enzyme composition. According to an alternative embodiment of the invention, a solid or liquid concentration composition can be provided in a formulation suitable for adfixing inside a washer or other apparatus and may be comprised of the organic activator-stabilizer compound source (e.g., heat-deactivated enzymes) and other optional functional ingredients. According to such an embodiment, the enzyme source (non-deactivated) is added during the cleaning application as further described according to the methods of use of the present invention.

The methods of manufacture of the various compositions formulations disclosed herein are well known to a skilled artisan and such methods of manufacture are not critical to the present invention.

Methods of Generating Carbonate in a Use Solution

In an aspect of the invention alkali metal carbonate salts can serve as a source of alkalinity. However, traditionally there has been a difficulty producing large volumes of a carbonate-based use solution. In particular embodiments of the invention, the food processing surface to be cleaned is a large surface and would require large volumes of a use solution. Alkali metal carbonate salts, particularly sodium carbonate, have low water solubility. Potassium carbonate has a better water solubility but is expensive, which is often cost prohibitive. Surprisingly, however, it has been found and demonstrated by the present invention that by using a secondary alkalinity source in conjunction with a carbonate-based alkalinity source, under an enriched $CO_2$ atmosphere, large volumes of carbonate-based use solution can be achieved at a buffered alkaline pH. Thus, in a particular embodiment of the invention an alkaline pH can be achieved and maintained for optimal cleaning, under an enriched $CO_2$ atmosphere by improving the solubility of a carbonate-based alkalinity source in water by driving an equilibrium with a secondary alkalinity source as the carbonate-based alkalinity source and $CO_2$ react. In solution with the carbonate-based alkalinity source, the $CO_2$ forms carbonic acid. The equilibrium of secondary alkalinity source, carbonic acid, carbonate, and bicarbonate can buffer the use solution to achieve optimal pH for cleaning, low reduction in pressure, and large volumes of carbonate-based use solution for cleaning.

In a particular embodiment of the invention the secondary alkalinity source may comprise an alkali metal hydroxide. In such an embodiment, the equilibrium will comprise bicarbonate, carbonic acid, carbonate, and hydroxide. This equilibrium is demonstrated in FIG. 1. In a further aspect of this embodiment, the $CO_2$ and hydroxide react to generate carbonate in situ. The reaction of $CO_2$ and hydroxide can be buffered by controlling the amount of carbonate present in the use solution. In a further embodiment of the invention the pH and/or conductivity may be monitored and controlled. Adjusting the pH can result in an equilibrium that favors generation of carbonate over the hydroxide ions in the use solution. By favoring the carbonate in the use solution, the reaction of the of $CO_2$ and hydroxide may be limited, which limits the reduction in pressure so that reductions exceeding the specification of the CIP tank can be prevented. Thus, tank implosion can be prevented and the pH can be maintained at an alkaline level under an enriched $CO_2$ atmosphere.

In an aspect of the invention, the secondary alkalinity source may be added to maintain a pH of the use solution between about 8 and about 13, more particularly between about 8.5 and about 12, even more particularly between about 9 and 11.

Figure 2:
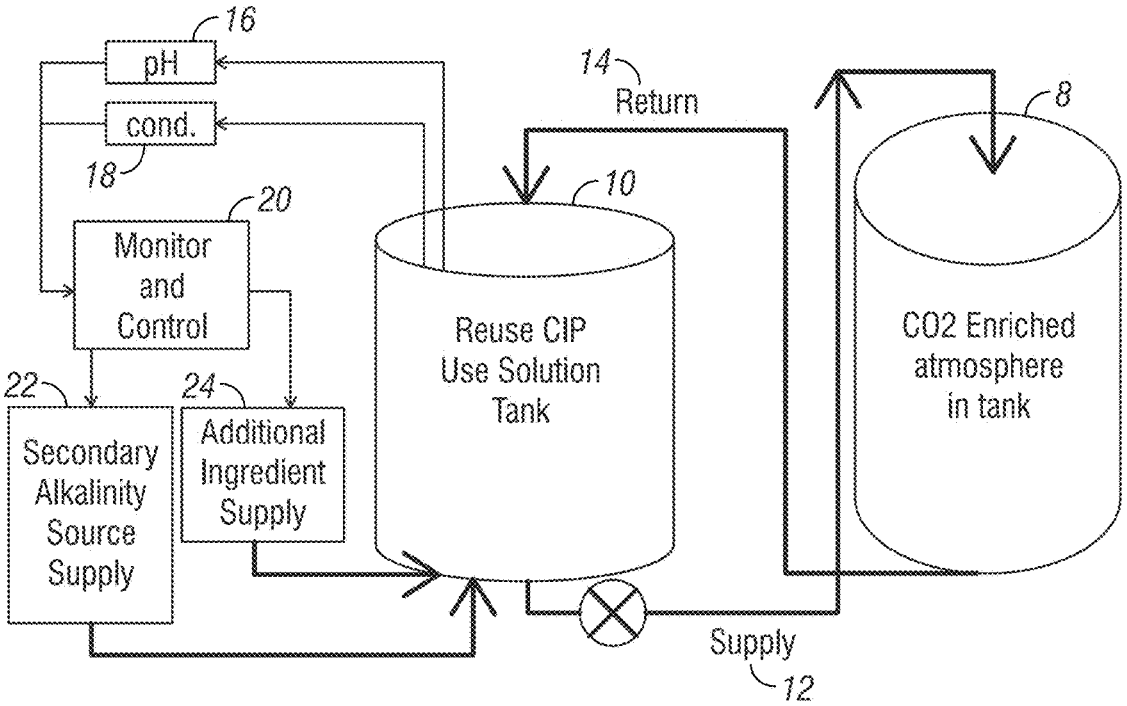
FIG. 2 is a schematic diagram of non-limiting embodiments of the method of generating carbonate in situ in a use solution in a CIP cleaning technique.

FIG. 2 demonstrates a non-limiting embodiment of the invention, where the method may employ a conductivity meter 18 and/or pH meter 16. The apparatuses, meters, and/or sensors suitable for measuring or monitoring carbonate content, hydroxide content, and/or pH within a use solution are not limited according to the invention. Beneficially, any such apparatuses, meters, and/or sensors which are compatible with the carbonate-based cleaning compositions according to the invention may be employed. In an aspect, the methods of the invention may include providing one or more meters 16, 18 and locating said meters 16, 18 in position to measure a sample of a use solution to determine the carbonate and/or hydroxide concentrations. In another embodiment of the invention, the meters can be located in or along a supply line 12 delivering the cleaning composition and/or use solution to a cleaning application, such as for example a CIP application. In still another embodiment of the invention, the meters may be built into a reuse CIP use solution tank 10, or have feed lines running out of a reuse CIP use solution tank attached to said meters. In still a further embodiment of the invention, the meters may be located in or along a return line 14 returning use solution from an enriched $CO_2$ atmosphere tank 8 to a reuse CIP use solution tank 10. The exact location of the meters is not critical to the methods of the invention and may be located in any place desired for the particular application. Rather, the ability to monitor the use solution is desired in particular embodiments of the invention. In a particular embodiment of the invention the meters feed into a monitor and control 20 that controls secondary alkalinity source supply 22, additional ingredient supply 24, and/or reuse CIP use solution 10.

In a further aspect of the invention, the conductivity of the ionic species in the use solution can be used to control the concentration of the components in the use solution including, but not limited to, the carbonate-based alkalinity source, secondary alkalinity source, surfactants, enzymes, and additional ingredients. By using either DC or AC conductivity in measurements of the use solution a supply tank, or multiple supply tanks, may be employed to deliver the carbonate-based alkalinity source, secondary alkalinity source, surfactants, enzymes, and additional ingredients in order to maintain the use solution at the desired concentration components.

The conductivity of the use solution can be measured using an electrical conductivity measurement means. In a particular embodiment, as the conductivity of the use solution drops, typically the concentration of the carbonate, hydroxide, and/or other components in the use solution is reduced proportionally. The use solution can be replenished of components, including, but not limited to carbonate-based alkalinity source, secondary alkalinity source, surfactant, enzyme, and additional ingredients by delivering the components from a supply tank into the use solution. By monitoring the conductivity created by the ionizable materials in the aqueous solution, the concentration of the enzyme component and other surfactants and other ingredients can also be controlled quite closely. In a particular embodiment, the conductivity of the use solution is maintained between about 500 and 1500 μsiemens/cm to provide an adequate concentration of carbonate, hydroxide, and other ingredients such as enzyme and surfactant. Although measurements of conductivity have long been used as a means of investigating the properties of electrolytes in solution, such as dissociation, activity, formation of complexes, and hydrolysis, such measurements also provide the basis for instrumentation used in industry to detect the ionic contamination of water and to determine the concentration of simple electrolytic solutions (see Van Nostrand's Scientific Encyclopedia, 6th Edition, Volume I, pp. 1056-1058). In this reference, the term electrolytic conductivity has been applied almost exclusively to water solutions of electrolytes in which the mechanism of electrical current transfer is dependent on ions. Solid and fused salts, however, also exhibit electrolytic conductivity.

Electrolytic conductivity (specific conductance) is defined as the electrical conductance of a unit cube of electrolytic solution. It is expressed in the same units as electrical conductivity, i.e., reciprocal ohms per unit length. The most common conductivity units are: Mhos/cm, siemens/cm, microsiemens/cm (μS/cm) and siemens/meter (1 mho/cm=1 siemens/cm=100 siemens/meter).

Typically the conductivity increases to a maximum value and then decreases with increasing concentration. Sometimes an additional point of inflection may occur. The conductivity of salt solutions typically increase with temperature. Pure water changes somewhat more with changes in temperature while strong acids and bases change somewhat less. From the foregoing discussion it can be seen that the value of a conductivity measurement is useless without knowledge of the temperature at which the measurement was made.

Electrolytic conductivity is most often measured by placing electrodes in contact with the electrolytic solution which is contained in such a way that the measured electrical conductance between the electrodes can be related to the conductivity of the solution. A conductivity cell commonly comprises an enclosure made of electrically insulating material such as glass or plastic which holds a portion of the solution and accommodates the two electrodes. The cell constant of such a device is then used to relate the measured electrical conductance between the electrodes to the actual electrolytic conductivity. Two electrodes 1 centimeter square located on opposite interior faces of a hollow cube 1 centimeter on an edge would have a cell constant of 1/cm, and a measured conductance of 0.005 mhos/cm (0.5 siemens/meter) at 25° C.

If the electrical conductance between the electrodes is measured with direct current, the resulting electrolysis and gas evolution can interfere with the current passage and changes the composition of the solution. Alternating current measurements greatly reduces these interfering factors, and finds wide use in such measurements. Properly designed inductive AC conductivity cells operated at appropriate alternating current frequencies obey Ohm's law since the current through the cell is proportional to the applied voltage and the conductivity of the electrolytic solution. Alternating current Wheatstone bridges and conductance meters make up the most widely used instrumentation accepted for electrolytic conductivity measurements. Changes in solution temperature change bridge characteristics similarly, thereby allowing the bridge to remain balanced except for actual changes in solution concentration. Conductivity meters generally apply a constant alternating voltage across the electrodes and respond to the resulting flow of current, which is proportional to the conductivity of the solution. Means of automatic temperature compensation are also included in such circuitry.

Measurements of electrolytic conductivity by means of electrical induction can be done without the use of contacting electrodes. Such measurements are made by inducing an alternating current in an electrolyte by use of a coil of wire. The magnitude of the induced current is proportional to the conductivity of the electrolyte. Current is caused to flow in a closed circular path through the electrolyte by a first coil of wire wound on a toroidal core of magnetic material. The magnitude of the current and hence the conductivity is measured by a second similar coil. A typical laboratory-type DC conductivity cell, which employs two platinized platinum electrodes contained in an open-bottom cylindrical chamber formed from Pyrex glass. This cell has a cell constant of 0.5/cm and is intended for use in measuring the conductivity of distilled water and other dilute solutions used in the laboratory. This kind of cell is dipped into an open-topped container containing the sample to be measured. Wide use is made in the laboratory of conductivity cells of this type in ascertaining water quality and in screening samples to be titrated or further analyzed by other means. A large variety of conductivity cells are available for use including DC and AC cells, electroless cells and others.

Methods of Cleaning

According to an embodiment of the invention, a food process surface is contacted by a cleaning composition. The cleaning composition may be in a concentrate or a diluted form. Contacting can include any of numerous methods known by those of skill in the art for applying a compound or composition of the invention, such as spraying, immersing the food process surface in the cleaning composition or use solution, dispensing the cleaning composition over a surface in granular or particulate form, simply pouring the cleaning composition or a use solution onto or into the food process surface, rinsing the food processing surface with a use solution, or a combination thereof.

In a particular embodiment, the method of cleaning utilizes a carbonate-based alkalinity source in the cleaning composition, the required volume of cleaning composition can be diluted in a use solution or can become the use solution without dilution. The use solution can be applied in a non-recirculating single-use technique, recirculated through the food process surface to be cleaned in a closed loop, or returned to a supply tank and optionally recirculated back into the food process surface or retained for another cleaning application.

Figure 3:
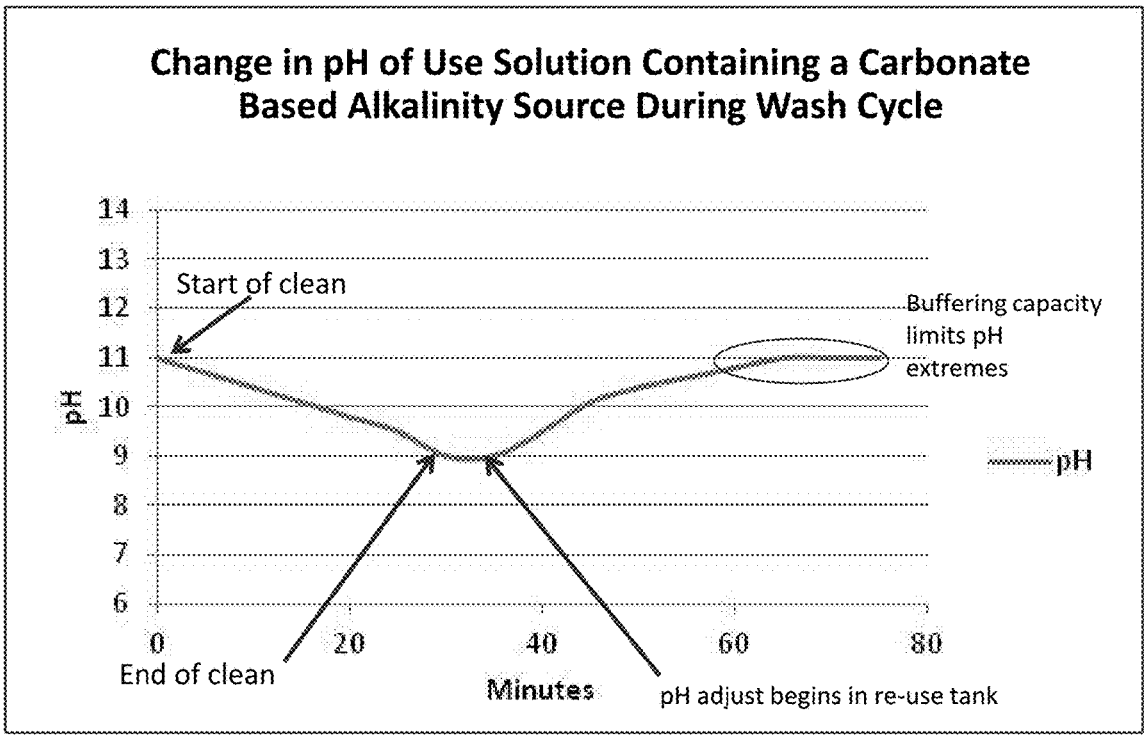
FIG. 3 is a graph that shows the change in pH of a use solution containing a carbonate-based alkalinity source being exposed to a $CO_2$ enriched atmosphere under the method of the present invention. The pH drops over time as $CO_2$ forms carbonic acid in solution and reacts with the alkalinity source. The $CO_2$ exposure is stopped at the valley of the curve. The rise in pH is accomplished by addition of a secondary alkalinity source to the use solution so that the pH is adjusted back to the optimal carbonate range of about pH 11. Inherent buffering capacity in the solution limits extreme pH swings.

When cleaning under an enriched $CO_2$ atmosphere the pH can drop from about 10.5-11.5 down to about 8.5-9.5. FIG. 3 demonstrates this in an exemplary graph of the pH change over the course of a wash cycle in a particular embodiment of the invention. This pH drop is caused by the formation of carbonic acid and consumption of $CO_2$. The inherent buffering capacity of the use solution provides a control mechanism for the pH rate of change. Thus, the use solution acts as a buffer and limits the total consumption of $CO_2$ as well as the effective pH drop, keeping the final pH alkaline.

Methods and apparatuses for monitoring the pH are well-known by those of skill in the art and any suitable method or apparatus may be employed, including for example a pH probe that may be housed within the washing vessel. Examples of suitable measuring mechanisms for use in the invention as disclosed in more detail, for example in U.S. Patent Application Publication No. 2012/0000488 A1, the disclosure of which is incorporated by reference herein in its entirety.

According to an embodiment of the invention, the recycling of the carbonate-based alkalinity source includes the use of the spent cleaning composition and alkalinity source to be added directly into a use solution. The use of the exhausted carbonate-based alkalinity source directly into the use solution assists in maintaining the optimal pH and in maintaining the equilibrium of $CO_2$ consumption so that the reduction in pressure does not exceed the specifications of the particular CIP tank. In another aspect of the invention, a second alkalinity source may be added to the use solution in the supply tank or in a line returning the used wash solution to the supply tank during the wash cycle or upon completion of the wash cycle. This second alkalinity source reacts with the use solution and/or any residual $CO_2$, raising the pH back to the desired starting pH of about 10-12.

In a particular aspect of the invention, the reaction of $CO_2$ with a secondary alkalinity source generates carbonate in situ in the use solution, thereby increasing the carbonate in the use solution. This can be particularly helpful in replenishing any carbonate use solution lost between wash cycles. Moreover, this reaction can be used to control the equilibrium of carbonate, carbonic acid, bicarbonate, and in particular embodiments, hydroxide in order to achieve optimal pH for a particular cleaning application. Optimal pH may be determined by a number of factors including the addition of other components in the use solution, the surface being cleaned, the soils being cleaned, etc.

At any time during or after the conclusion of a wash cycle additional surfactant can be added to the use solution. This may be desired to keep the concentration of surfactant at a particular concentration value or to increase the concentration of surfactant in the use solution.

The method of cleaning may employ an enzyme composition, which can be incorporated in the cleaning composition, added during the wash cycle, or prior to the next cycle commencing.

The method of cleaning of the present invention is capable of effectively cleaning over a broad range of temperatures. The method of cleaning may be performed at temperatures between about 5° C. and about 100° C. In a particular embodiment, the method may be performed at temperatures between about 20° C. and about 60° C. In another embodiment, the method may be performed at temperatures between about 35° C. and about 50° C.

Brewery Surface CIP Single Use Technique

According to an embodiment of the invention, the method of cleaning may be used in a brewery surface CIP technique under an enriched $CO_2$ atmosphere. In a further embodiment, the CIP technique may employ single use equipment. The method can be performed at a temperature between about 5° C. and about 100° C. In another embodiment of the invention, the method can be performed at a temperature between about 25° C. and about 60° C. In a further embodiment of the invention, the method can be performed at a temperature between about 35° C. and about 50° C.

In an aspect of the invention, the method will employ a carbonate-based alkalinity source in an amount between about 0.1% and about 5% by weight of the total weight of the cleaning composition. In another embodiment of the invention, the method will employ a carbonate-based alkalinity source in an amount between about 0.5% and about 2% by weight by weight of the total weight of the cleaning composition. In a further embodiment of the invention, the method will employ a carbonate-based alkalinity source in an amount between about 0.8% and about 1.5% by weight of the total weight of the cleaning composition. The cleaning composition will be contacted with the brewery surface CIP equipment as a use solution. The contacting can be performed in any suitable way. Examples, include, but are not limited to, spraying and pouring. In a further aspect of the invention, a secondary alkalinity source may be added to the use solution. In a particular embodiment, the secondary alkalinity source may comprise an alkali metal hydroxide.

In an embodiment employing single use equipment, the method of cleaning does not return the use solution to a supply tank or recirculate it in a closed loop. Rather the use solution, remains in the CIP equipment during the wash cycle. In a particular embodiment, optimal cleaning may occur when the use solution has an alkaline pH, e.g., above pH 8. In an aspect of the invention, the secondary alkalinity source reacts with the $CO_2$ generating carbonate in situ in the use solution and causing the use solution to operate as a buffer thereby maintaining the pH between about 8 and about 12; preferably between about 8.5 and about 11.5. In a further aspect of the invention, the operation of the use solution as a buffer limits the total consumption of $CO_2$ preventing a reduction in pressure exceeding the specifications of the CIP tank.

In a further aspect of the invention, the pH of the use solution may be monitored by any known method of monitoring pH, including for example a built-in pH meter. In a particular embodiment of the invention, the pH of the use solution may be adjusted by adding a secondary alkalinity source. In other embodiments of the invention, the pH may not be monitored and adjusted.

In still a further aspect of the invention, the conductivity of the use solution may be monitored by any known method of monitoring conductivity, including for example a built-in conductivity meter. In a particular embodiment of the invention, the conductivity of the use solution may be adjusted by adding a secondary alkalinity source. In other embodiments of the invention, the conductivity may not be monitored and adjusted.

Brewery Surface CIP Closed Loop Technique

According to an embodiment of the invention the method of cleaning may be used in a brewery surface CIP closed loop technique under an enriched $CO_2$ atmosphere. The method can be performed at a temperature between about 5° C. and about 100° C. In another embodiment of the invention, the method can be performed at a temperature between about 25° C. and about 60° C. In a further embodiment of the invention, the method can be performed at a temperature between about 35° C. and about 50° C.

In an aspect of the invention, the method will employ a carbonate-based alkalinity source in an amount between about 0.1% and about 5% by weight by weight of the total weight of the cleaning composition. In another embodiment of the invention, the method will employ a carbonate-based alkalinity source in an amount between about 0.5% and about 2% by weight by weight of the total weight of the cleaning composition. In a further embodiment of the invention, the method will employ a carbonate-based alkalinity source in an amount between about 0.8% and about 1.5% by weight of the total weight of the cleaning composition. The cleaning composition will be contacted with the brewery surface CIP equipment as a use solution. The contacting can be performed in any suitable way. Examples, include, but are not limited to, spraying and pouring.

In an embodiment employing closed loop equipment, the method of cleaning can recirculate the use solution through the brewery surface being cleaned. Thus, in a particular embodiment the recirculation of the use solution can be performed in any suitable method of recirculating the use solution. Such methods are well known and understood by those of skill in the art. An example, includes, but is not limited to, using a closed loop that recirculates the use solution through a built-in spray nozzle.

In a particular embodiment, optimal cleaning may occur when the use solution has an alkaline pH, e.g., pH equal to and greater than 8. In a particular embodiment of the invention, a secondary alkalinity source may be added to the use solution. In an aspect of the invention, the secondary alkalinity source reacts with the $CO_2$ generating carbonate in situ in the use solution and causing the use solution to operate as a buffer thereby maintaining the pH between about 8 and about 12; preferably between about 8.5 and about 11.5. In a further aspect of the invention, the operation of the use solution as a buffer limits the total consumption of $CO_2$ preventing a reduction in pressure exceeding the specifications of the CIP tank.

In a further aspect of the invention, the pH of the use solution may be monitored by any known method of monitoring pH, including for example a built-in pH meter. In a particular embodiment of the invention, the pH of the use solution may be adjusted by adding a secondary alkalinity source. In an aspect of the invention adding a secondary alkalinity source may comprise recirculating the use solution, recirculating the use solution with another alkalinity source, or simply adding another alkalinity source. In other embodiments of the invention, the pH may not be monitored and adjusted.

In still a further aspect of the invention, the conductivity of the use solution may be monitored by any known method of monitoring conductivity, including for example a built-in conductivity meter. In a particular embodiment of the invention, the conductivity of the use solution may be adjusted by adding a secondary alkalinity source. In other embodiments of the invention, the conductivity may not be monitored and adjusted.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used in the following Examples are provided herein:

Savinase®: a protease enzyme available from Novozymes, Inc.

Stainzyme®: an amylase enzyme available from Novozymes, Inc.

Carezyme®: a cellulase enzyme available from Novozymes, Inc.

Triton™ DF-12 Surfactant: a nonionic surfactant available from the Dow Chemical Company.

Additional materials commercially-available from multiple sources include: soda ash.

Example 1

Two soiled CIP brewery fermentation tanks were selected. Pictures were taken of both soiled tanks before and after the cleaning (FIGS. 4A-D). A carbonate-based cleaning composition was prepared as provided in Table 1 in one of the soiled tank.

TABLE 1

| Cleaning Composition A | |
|---|---|
| Ingredient | Concentration (wt. %) |
| Savinase ® | 0.2 |
| Stainzyme ® | 0.1 |
| Carezyme ® | 0.05 |
| TritonTM DF-12 Surfactant | 0.01 |
| Soda Ash | 1 |
| Water | Balance |

The brewery fermentation tank was about 33% $CO_2$ at 1 atm. The wash method was performed at a temperature between about 40° C. to about 45° C. The tank was sealed except for two, 2" diameter vent holes. Cleaning Composition A was applied to the tank through a conventional spray ball nozzle in 20 second bursts, for three minutes. The cleaning method was performed for 30 minutes, which included recirculation of the use solution through the spray ball nozzle. The pH was measured using a standard handheld probe pH monitor after the wash cycle to evaluate the ending pH, which was alkaline.

The other soiled CIP brewery fermentation tank was cleaned with a traditional phosphoric acid brewery detergent for thirty minutes. As is traditional for acid-based cleaning, the cleaning was performed at about ambient temperature. The tank was under about 33% $CO_2$ at 1 atm. The phosphoric acid brewery detergent was applied to the tank through a conventional spray ball nozzle in 20 second bursts, for three minutes. The cleaning method was performed for 30 minutes, which included recirculation of the use solution through the spray ball nozzle.

Figure 4A:
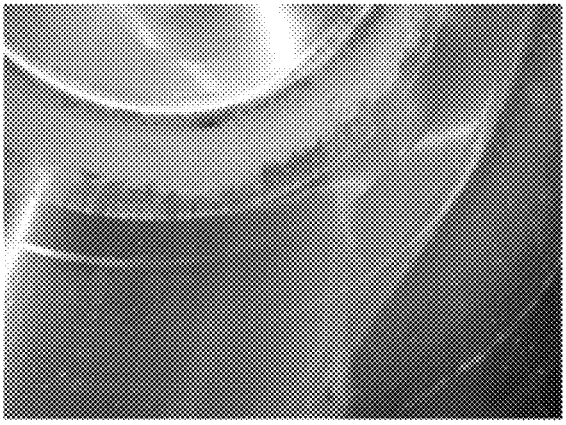
FIG. 4A shows a soiled brewery fermentation vessel prior to acid-based cleaning.
Figure 4B:
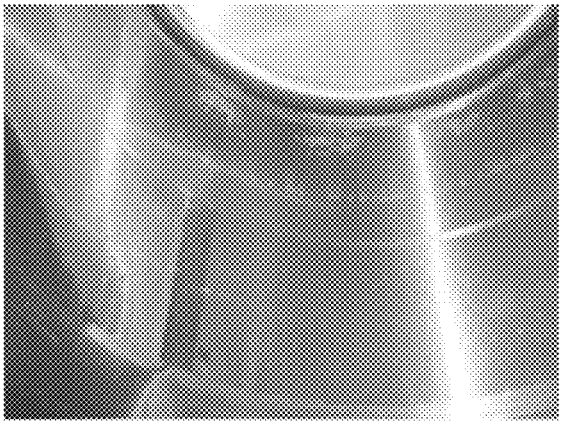
FIG. 4B shows the soiled brewery fermentation vessel of FIG. 3A after thirty minutes of acid-based cleaning at ambient temperature under about 33% $CO_2$ at 1 atm.
Figure 4C:
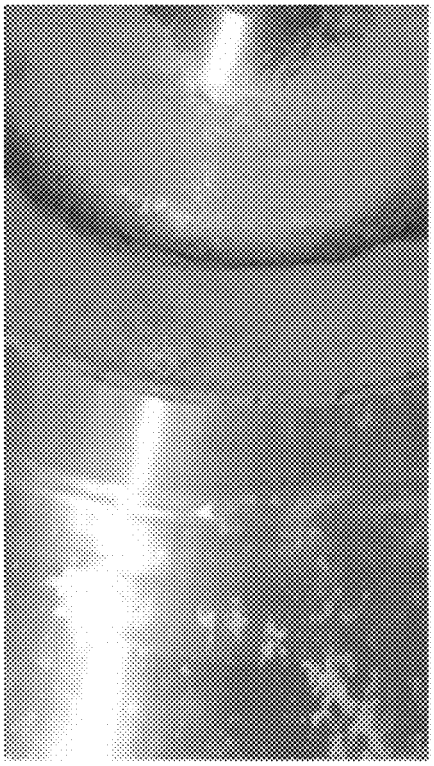
FIG. 4C shows a soiled brewery fermentation vessel prior to cleaning with the claimed method of cleaning and Cleaning Composition A.
Figure 4D:
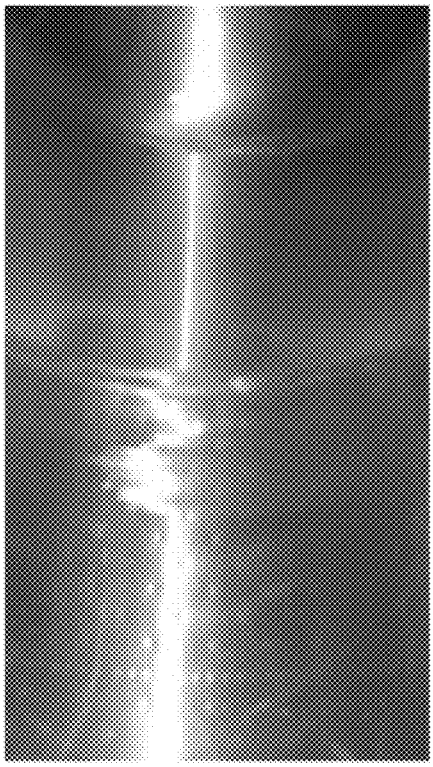
FIG. 4D shows the soiled brewery fermentation vessel of FIG. 3C after thirty minutes of cleaning with the claimed method of cleaning and Cleaning Composition A at a temperature between about 40° C. and about 45° C. under about 33% $CO_2$ at 1 atm.

After thirty minutes of cleaning, both CIP brewery fermentation tanks were examined and pictures were taken of the inside of the tanks (FIG. 4B (cleaned with the acid detergent) and FIG. 4D (cleaned with Cleaning Composition A). As is demonstrated by FIGS. 4B and 4D, the tank cleaned with Cleaning Composition A, under the claimed method of cleaning demonstrated much better soil removal than the tank cleaned under an existing acid cleaning method.

Example 2

Four liters of Cleaning Composition A (Table 1) were added to a 20-liter pressure tank with a built-in pressure gauge. The pressure tank was enriched to about 75% $CO_2$ at 1 atm. The tank was sealed and agitated. Similarly, four liters of a sodium hydroxide detergent were added to a 20-liter pressure tank with a built-in pressure gauge. The pressure tank was enriched to about 75% $CO_2$ at 1 atm. Again, the tank was sealed and agitated.

Figure 5:
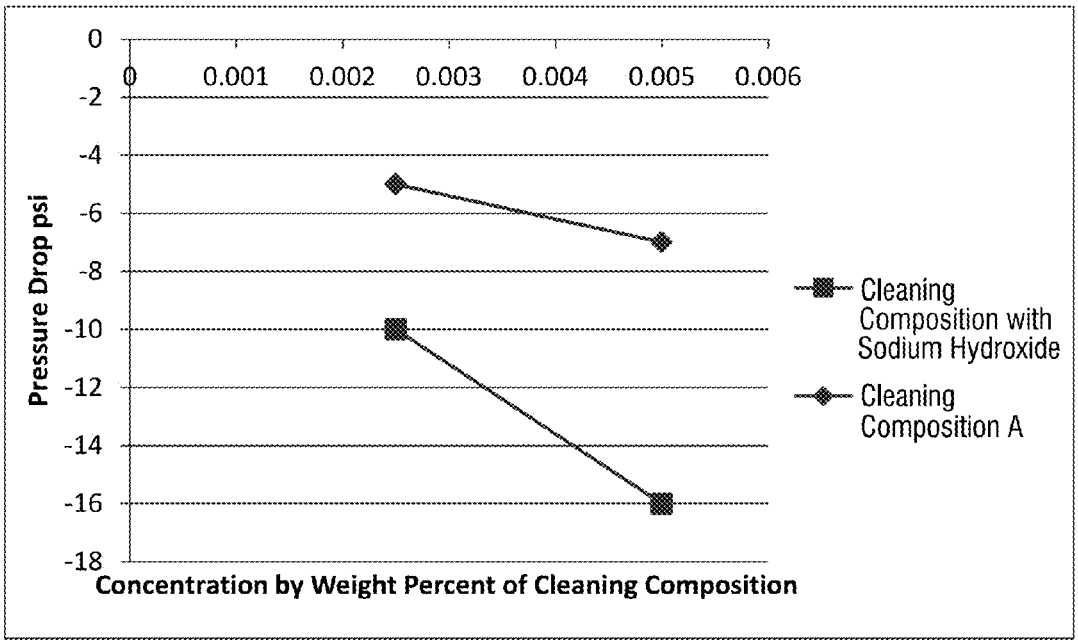
FIG. 5 shows the difference in the change in pressure of a 20-L tank under about 75% $CO_2$ atmosphere when the cleaning composition is a sodium hydroxide-based composition compared with carbonate-based cleaning composition.

When Cleaning Composition A was used, the reduction in pressure was about 2 psi as the sodium carbonate solution increased in concentration. When the sodium hydroxide detergent was used, the pressure was immediately lower and reduced by about 6 psi. The compared change in pressure is displayed in FIG. 5.

The NaOH detergent consumed about twice as much $CO_2$. This resulted in the dramatic reduction in pressure and in a neutral to mildly acidic pH. The substantial addition of more NaOH is necessitated by the caustic detergent because the pH lowers as the NaOH and $CO_2$ react. Thus, using a caustic detergent under an enriched $CO_2$ atmosphere is prohibitive because it would require an excess of NaOH and complete consumption of $CO_2$. This would cause a pressure drop in the tank that may eventually result in tank implosion. However, the use of a carbonate alkalinity source, as employed in the claimed method, resolves the problem of pressure reduction that caustic detergents are subject to.

The above specification provides a description of the manufacture and use of the disclosed compositions and methods. Since many embodiments can be made without departing from the spirit and scope of the invention, the invention resides in the claims.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A method of cleaning a brewery surface with a carbonate use solution comprising:

forming a cleaning composition comprising:

(a) a carbonate-based alkalinity source present between about 0.5 wt. % and about 2 wt. %, (b) a surfactant present between about 0.01 wt. % and about 2 wt. %, (c) an enzyme composition present between about 0.035 wt. % and about 1.75 wt. %;

(d) water;

applying said cleaning composition to the brewery surface as a use solution under an enriched $CO_2$ atmosphere monitoring the use solution during the applying step;

adjusting the pH of the use solution to maintain it between about 8 and about 12; and generating carbonate in situ in the use solution.

2. The method of claim 1, Wherein said monitoring comprises monitoring the pH, the conductivity, or both.

3. The method of claim 1, wherein adjusting the pH comprises recirculating the use solution.

4. The method of claim 1, wherein adjusting the pH comprises adding a secondary alkalinity source.

5. The method of claim 4, wherein the secondary alkalinity source is an alkali metal hydroxide.

6. The method of claim 1, wherein any reduction in pressure does not exceed the specification of the brewery surface during the applying step.

7. The method of claim 1, wherein the brewery surface is a single use system.

8. The method of claim 1, wherein the brewery surface is a closed loop system.

9. A method of cleaning a food processing surface with a CIP technique comprising:

forming a cleaning composition comprising:

(a) an alkali metal carbonate present between about 0.5 wt. % and about 2 wt. %, (b) a nonionic surfactant present between about 0.01 wt. % and about 2 wt. %, (c) an enzyme composition present between about 0.035 wt. % and about 1.75 wt. %; and (d) water;

applying said cleaning composition to the food processing surface as a use solution under an enriched $CO_2$ atmosphere;

monitoring the pH of the use solution during the applying step;

adjusting the pH of the use solution to maintain it between about 8 and about 12, wherein said adjusting comprises recirculating the use solution, adding a secondary alkalinity source, or both recirculating the use solution and adding a secondary alkalinity source; and generating carbonate in situ in the use solution.

10. The method of claim 9, wherein the monitoring step further comprises monitoring conductivity.

11. The method of claim 9 wherein adjusting the pH is performed by recirculating the use solution.

12. The method of claim 9, wherein adjusting the pH is performed by adding the secondary alkalinity source.

13. The method of claim 12, wherein the secondary alkalinity source is an alkali metal hydroxide.

14. The method of claim 9, wherein adjusting the pH is performed by recirculating the use solution and adding a secondary alkalinity source.

15. The method of claim 9, wherein any reduction in pressure does not exceed the specification of the food processing surface during the applying step.

16. The method of claim 9, wherein the food processing surface is a single use system.

* * * * *